US005839228A

United States Patent [19]

Duffy

[11] Patent Number: 5,839,228

[45] Date of Patent: Nov. 24, 1998

[54] SWING-UP SLIDING DOOR ARRANGEMENT

[75] Inventor: Philip Duffy, Cape Town, South Africa

[73] Assignee: Sterling Plumbing Group, Inc., Rolling Meadows, Ill.

[21] Appl. No.: 750,929

[22] PCT Filed: Aug. 17, 1995

[86] PCT No.: PCT/US95/10467

§ 371 Date: May 5, 1997

§ 102(e) Date: May 5, 1997

[87] PCT Pub. No.: WO96/04834

PCT Pub. Date: Feb. 22, 1996

[30] Foreign Application Priority Data

Aug. 17, 1994 [ZA] South Africa ..... 94/6212

[51] Int. Cl.[6] ..... E05D 15/10

[52] U.S. Cl. ..... 49/223; 49/209; 49/410; 49/222

[58] Field of Search ..... 49/209, 221, 222, 49/223, 224, 409, 410; 4/557, 558, 607, 608

[56] References Cited

U.S. PATENT DOCUMENTS

| | | | |
|---|---|---|---|
| 4,486,980 | 12/1984 | O'Bar | 49/222 X |
| 4,651,469 | 3/1987 | Ngian et al. | 49/223 |
| 4,769,949 | 9/1988 | Glendowne | 49/410 |
| 5,575,022 | 11/1996 | Duffy et al. | 49/213 X |

FOREIGN PATENT DOCUMENTS

| | | |
|---|---|---|
| 0 384 224 | 8/1990 | European Pat. Off. . |
| 2 334 331 | 7/1977 | France . |
| 3800 444 | 7/1989 | Germany . |
| 3800 445 | 7/1989 | Germany . |
| 3800 446 | 7/1989 | Germany . |
| 3807 010 | 9/1989 | Germany . |
| WO 93/05261 | 4/1993 | WIPO . |

*Primary Examiner*—Jerry Redman
*Attorney, Agent, or Firm*—Quarles & Brady

[57] ABSTRACT

A screen is provided having overlapping leaves, an upper rail on which the leaves are hung, and a lower rail for guiding the lower ends of the leaves during their sliding movement. A runner element whereby the lower end of an outer one of the leaves is guided with respect to the lower rail, is pivotally displaceable between a first condition in which it engages with the lower rail and a second condition in which it is disengaged from the lower rail, permitting the leaf to swing away from the other leaf. This facilitates cleaning of the leaves in the region where they overlap.

5 Claims, 7 Drawing Sheets

SWING-UP SLIDING DOOR ARRANGEMENT

CROSS REFERENCES TO RELATED APPLICATIONS

This application claims priority on International Application No. PCT/US95/10467 filed Aug. 17, 1995 which in turn claims priority on South African 94/6212 filed Aug. 17, 1994.

BACKGROUND OF THE INVENTION

This invention relates to a screen of the type having two or more overlapping sliding leaves or panels. Screens of this type are often used to form bathtub enclosures.

SUMMARY OF THE INVENTION

According to the invention, there is provided a screen which comprises two or more overlapping leaves or panels, an upper rail on which the leaves are hung and along which they can slide, and a lower rail for guiding the lower ends of the leaves during their sliding movement, at least an outer one of the leaves having runners which engage with the upper rail, the runners and upper rail being so constructed that the runners can tilt about a tilt axis extending along the upper rail, and said outer leaf having a pivotally mounted element which is pivotally displaceable between a first condition in which it engages the lower rail for guiding the outer leaf along the lower rail, and a second condition in which it is released from the lower rail, so as to enable the lower end of the outer leaf to swing transversely away from the lower rail, about the tilt axis.

The invention will not be described in more detail, by way of example, with reference to the accompanying drawings.

DETAILED DESCRIPTION

Figure 1:
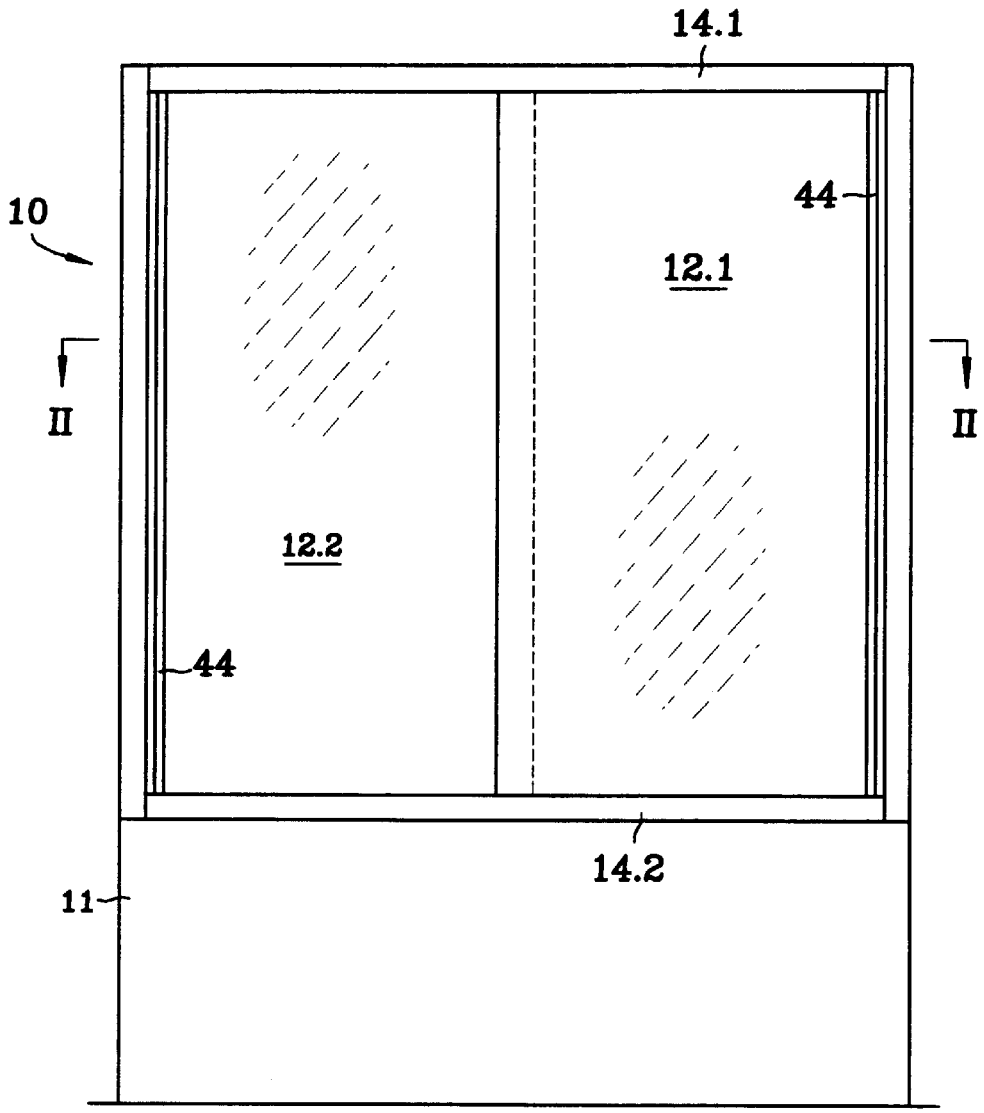
FIG. 1 is a front elevation of a screen in accordance with a first embodiment of invention.
Figure 2:
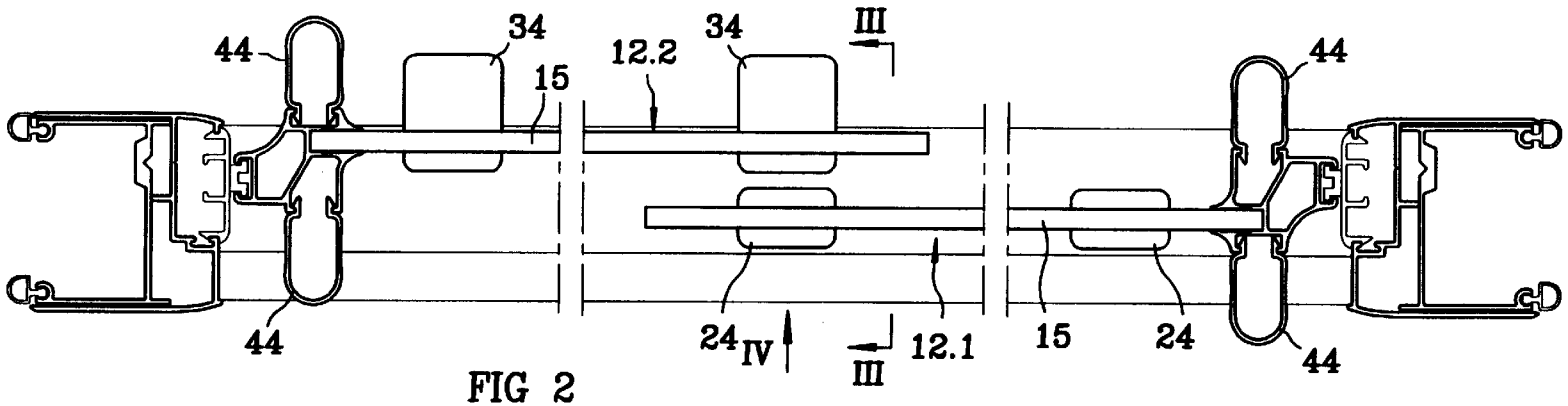
FIG. 2 is a broken section on II—II in FIG. 1.
Figure 13:
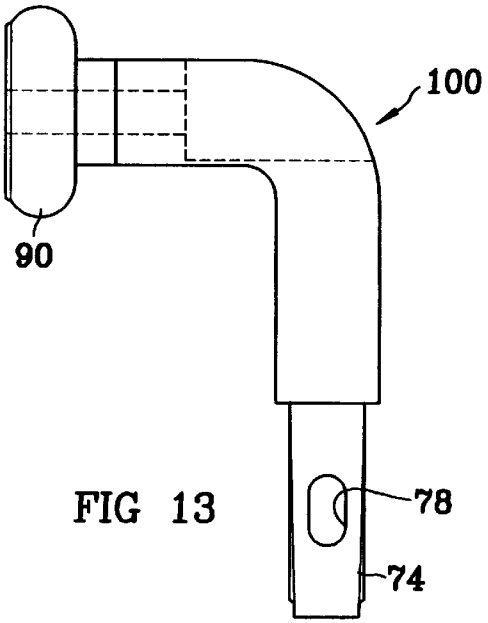
FIGS. 12 and 13 are views in the direction of arrow XII in FIG. 11, of the upper fittings of the two leaves respectively.
Figure 12:
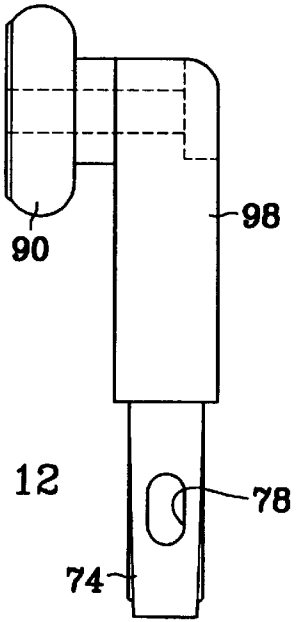
Figure 11:
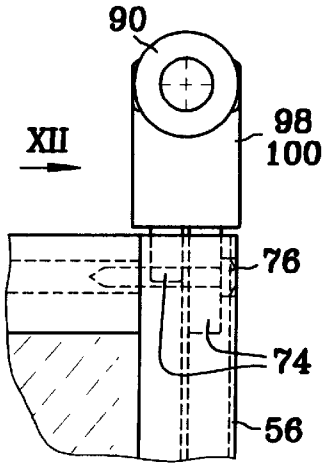
FIG. 11 is an elevation of an upper one of the fittings of two of the leaves of the screen, in the direction of arrow XI in FIG. 10.
Figure 3:
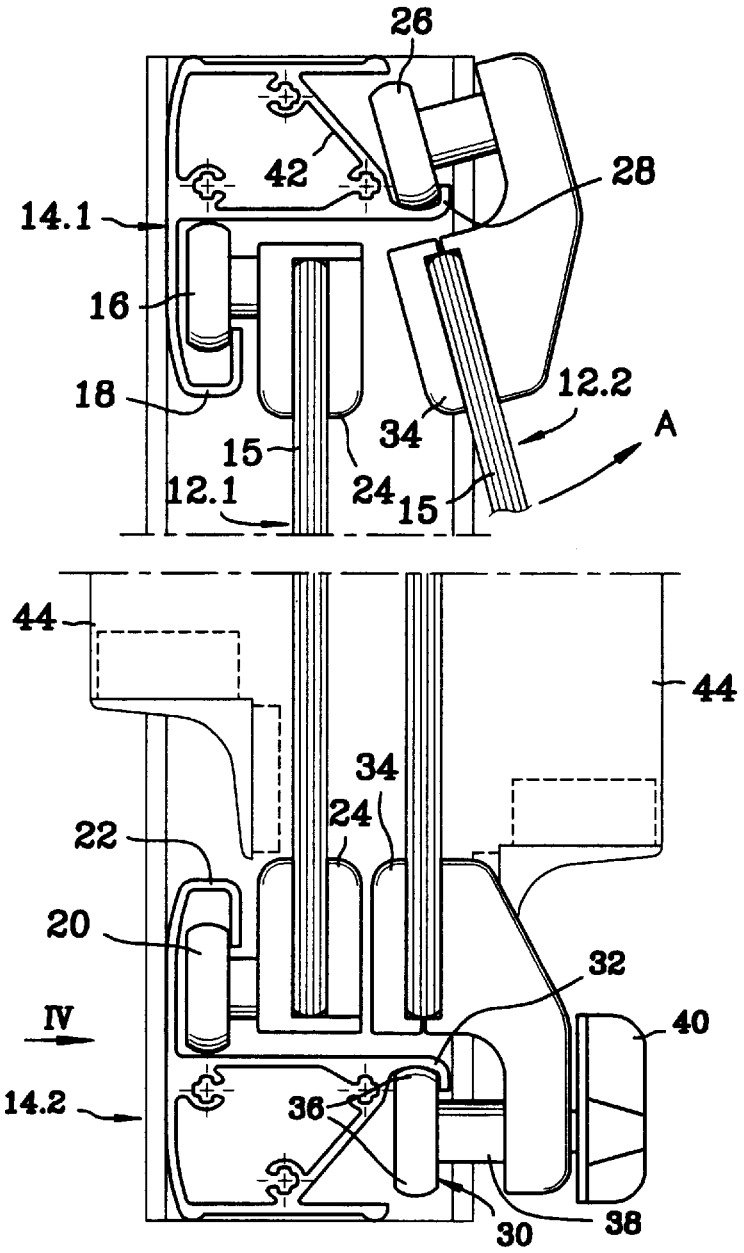
FIG. 3 is a broken section on III—III in FIG. 2.

Referring first to FIGS. 1 to 4, reference numeral 10 generally indicates a screen for a bathtub 11, the screen comprising two overlapping leaves or panels 12.1 and 12.2, an upper or head rail 14.1 on which the leaves are hung and along which they can slide, and a lower or sill rail 14.2 for guiding the lower ends of the leaves during their sliding movement. The upper and lower rails 14.1 and 14.2 form a portion of a bathing enclosure and are extruded aluminum sections, both of the same profile, the one being inverted with respect to the other. The leaves overlap to a certain extent, even when in the fully extended condition as shown in FIGS. 1 and 2. In conventional screens this makes it difficult to clean those areas which are between the overlapping parts. To enable these areas to be accessed for cleaning purposes, the leaf 12.2 is tiltable to the inside of the bathtub, as will be described in more detail hereinafter.

The leaves 12.1 and 12.2 each comprise a toughened glass panel 15. The leaf 12.1 is on the outside of the bathtub 11 and is hung on the upper rail 14.1 by means of a pair of runner wheels 16. The runner wheels 16 are able to run along a track 18 which forms part of the upper rail 14.1. The leaf 12.1 is a fixed leaf in the sense that, whilst it can move slidably along the rails 14.1 and 14.2, it is not able to tilt as in the case of the leaf 12.2. The lower end of the leaf 12.1 is guided with respect to the lower rail 14.2 by means of a pair of runner wheels 20. The runner wheels 20 are able to run along a track 22 which forms part of the lower rail 14.2. The runner wheels 16 and 20 are mounted on the glass panel 15 of the leaf 12.1 by means of patch fittings 24.

The leaf 12.2 is hung on the upper rail 14.1 by means of a pair of runner wheels 26. The runner wheels 26 are able to run along a track 28 which forms part of the upper rail 14.1. The lower end of the leaf 12.2 is guided with respect to the lower rail 14.2 by means of a pair of sliding runner elements 30. The runner elements 30 are able to run along a track 32 which forms part of the lower rail 14.2. The runner wheels 26 and the sliding runner elements 30 are mounted on the glass panel 15 of the leaf 12.2 by means of patch fittings 34.

Figure 4:
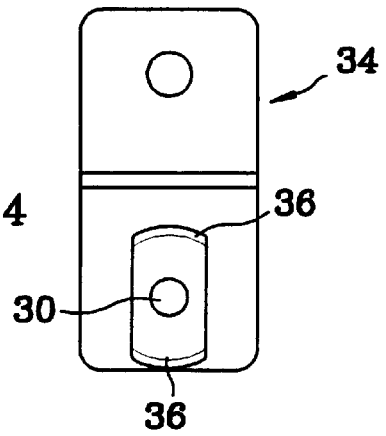
FIG. 4 is a detail elevation of a lower patch fitting, as seen in the direction of arrow IV in FIGS. 2 and 3.

As can best be seen in FIG. 4, the runner element 30 has a pair of oppositely extending lobes 36. It is mounted on a spindle 38 which in turn is mounted pivotally on the patch fitting 34. On the other side of the patch fitting, the spindle 38 has a winged head 40 whereby it can be gripped and the runner element 30 thereby pivoted between a first position (shown in FIGS. 3 and 4) in which one of the lobes 36 cooperates with the track 32 to guide the lower end of the leaf 12.2, and a second position in which the runner element 30 is pivoted through 90°. In the latter position, the runner element 30 is released from the track 32, making it possible to swing the leaf 12.2 transversely from the leaf 12.1 in the direction of arrow A, as illustrated in the upper half of FIG. 3. To make this swinging movement possible, the space in the extrusion 14.1 above the track 28 is left unobstructed, so as to allow the runner wheels 26 to tilt to the position illustrated in FIG. 3. To this end, a strengthening web 42 of the extrusion is disposed at an angle as shown in the drawing.

The parts 44 are handles for the leaves 12.1 and 12.2.

Figure 5:
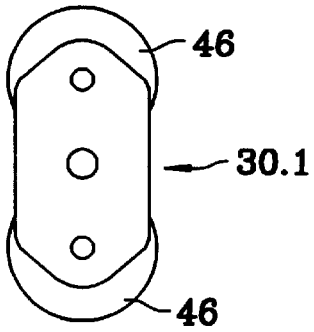
FIG. 5 is a view similar to FIG. 4, but showing an alternative construction.

Referring now to FIG. 5, there is shown an alternative form of runner element 30.1. Each of the lobes of the runner element 30.1 carries a runner wheel 46*b* to minimize friction between the runner element and the track 32 when the runner element engages with the track. The construction is such that, when the runner element 30.1 is rotated through 90° the runner wheels 46 will clear the track 32, so as to permit the tilting movement described above.

Figure 6:
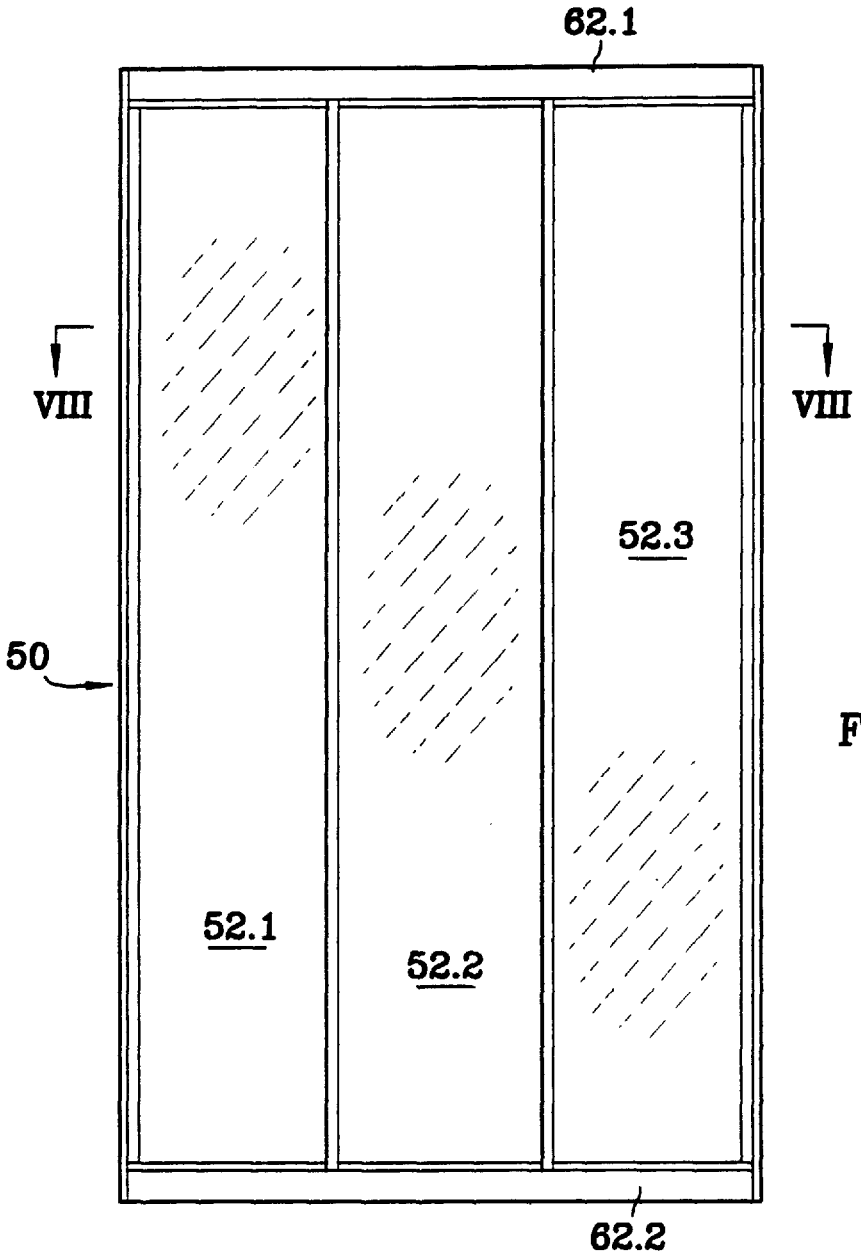
FIG. 6 is a front elevation of a screen in accordance with a second embodiment of the invention.
Figure 8A:
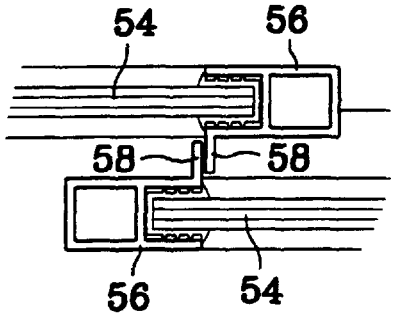
FIG. 8*a* is an enlarged view of the circled portion VIIIa in FIG. 8.
Figure 7:
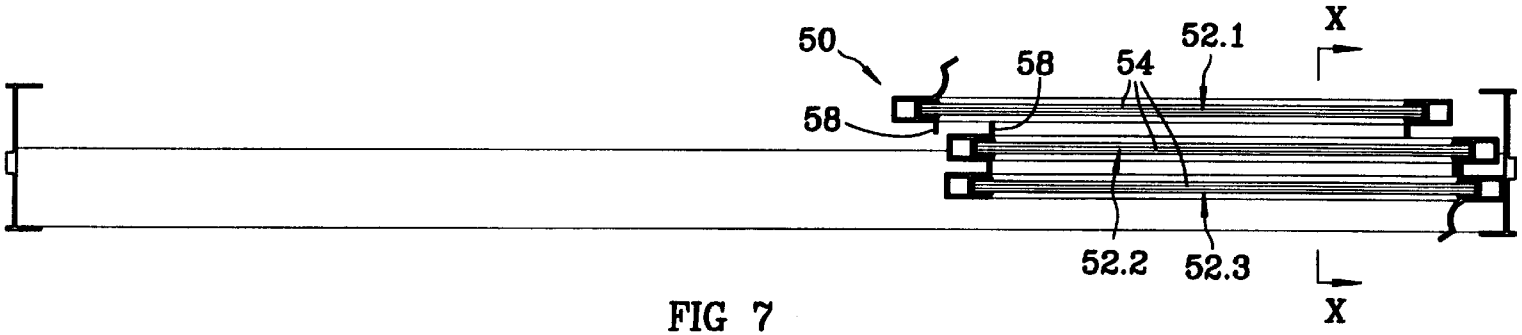
FIGS. 7, 8, and 9 are each a section of VIII—VIII in FIG. 6, showing the leaves of the screen in different positions.
Figure 8:
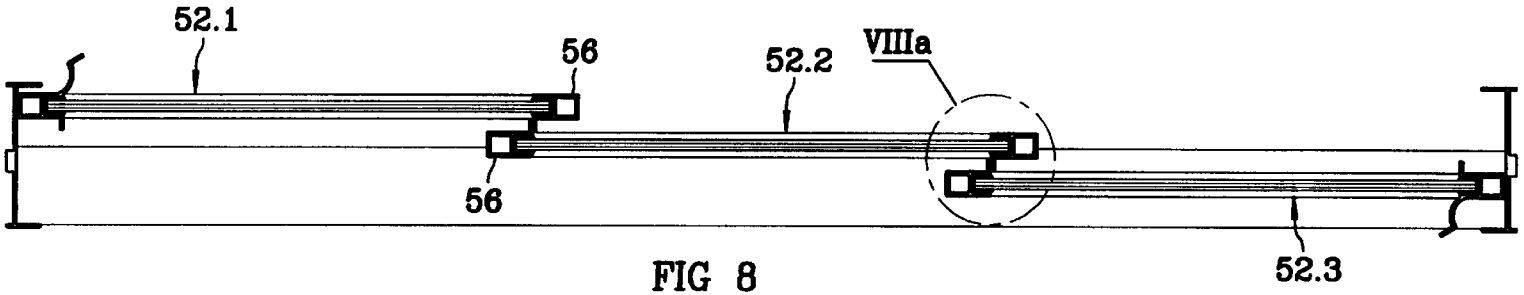
Figure 9:
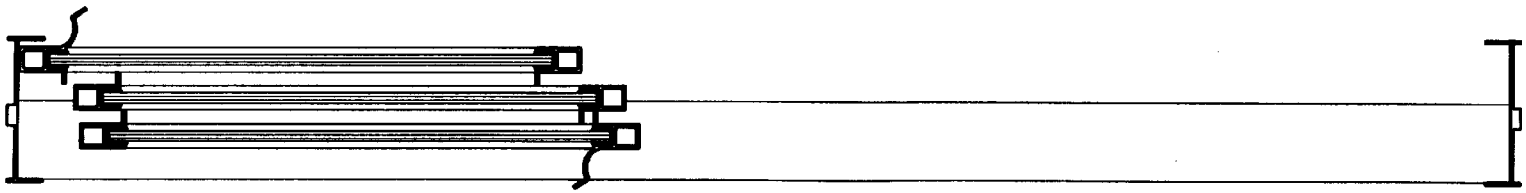

Referring now to FIGS. 6 to 20, reference numeral 50 generally indicates a screen which comprises three overlapping sliding leaves 52.1, 52.2, and 52.3. Each of the leaves consists of a toughened glass panel 54, there being stiles 56 of extruded aluminum along each vertical side of the glass panels. The styles 56 have stops 58 which, by interfering with one another, prevent the leaves from sliding beyond one another. This makes it difficult to clean those areas which are between adjacent leaves when the screen is in the fully extended condition as illustrated in FIGS. 6 and 8. To enable these areas to be accessed for cleaning purposes, the leaves 52.2 and 52.3 are tiltable as in the case of the leaf 12.2 in the FIGS. 1 to 4 construction.

The screen 50 has upper and lower rails 62.1 and 62.2, respectively. at its upper end, the leaf 52.1 is provided with a pair of runner wheels 64, whereby it is hung on the upper rail 62.1. The runner wheels 64 are able to run along a track 66 which forms part of the upper rail 62.1. At its lower end, the leaf 52.1 is provided with a pair of sliding runner elements 68. The runner elements 68 are each able to slide along a track 70 which forms part of the lower rail 62.2. The runner wheels 64 and the runner elements 68 are mounted on the frame members of the leaf 52.1 via carrier elements 72. The carrier elements 72 each have a pair of legs 74 (see FIGS. 17 to 20) which extend into cavities of the stile 56. The carrier elements 72 are each fixed in position by means of a screw 76. The carrier elements are manufactured with the two legs 74 initially being of equal length. Before installation, one of the legs is shortened, so that it does not interfere with the glass panel 54. For the one side of the leaf, one of the legs is shortened; and for the other side of the leaf, the other leg is shortened. The legs 74 each have a slotted hole 78 therein through which the screw 76*b* can pass. The slotted holes 78 enable the height of the carrier elements 72 to be adjusted before tightening the screws 76.

The runner element 68 has a single lobe 80 and is fixed to a spindle 82 which, in turn, is pivotally mounted on the carrier element 72. The shaft has a head 84 with a slot cut in it, so that it can be pivoted by making use of a screwdriver.

Figure 10:
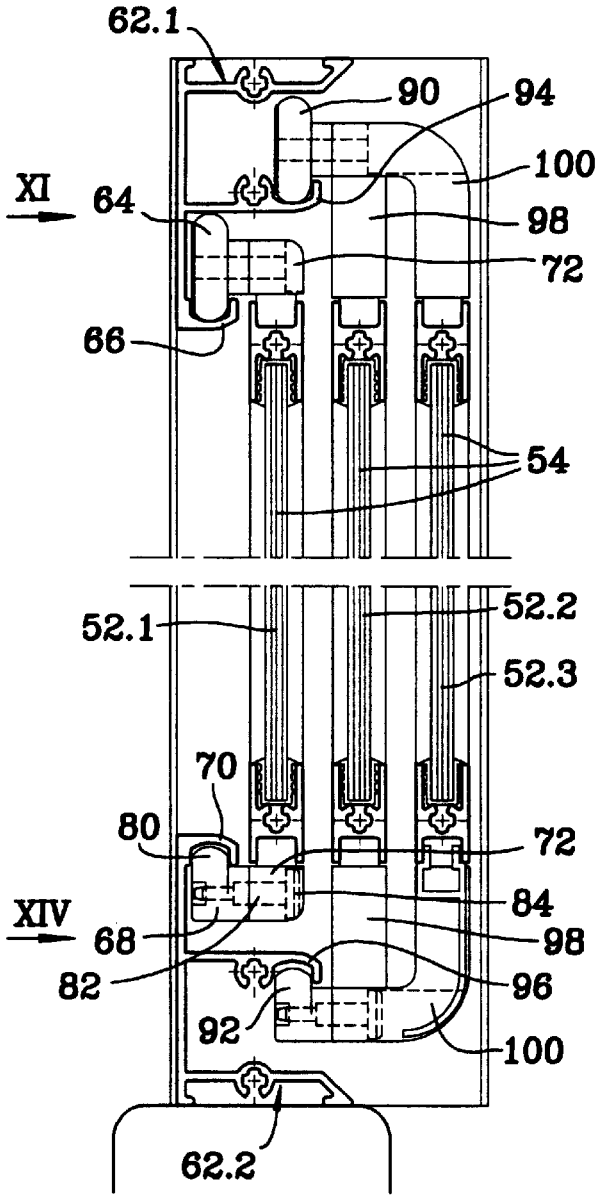
FIG. 10 is a section on X—X in FIG. 7.
Figure 19:
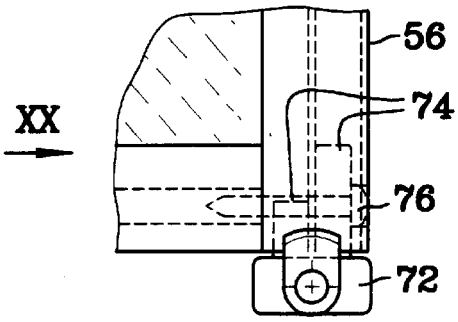
FIG. 19 is an elevation, in the direction of arrow XIV in FIG. 10, of a lower fitting of the screen.
Figure 20:
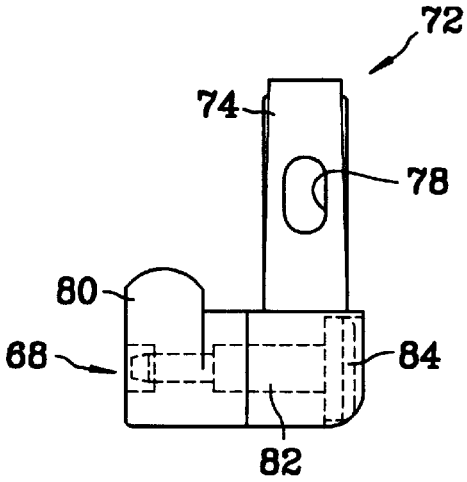
FIG. 20 is a view in the direction of XX in FIG. 19.
Figure 14:
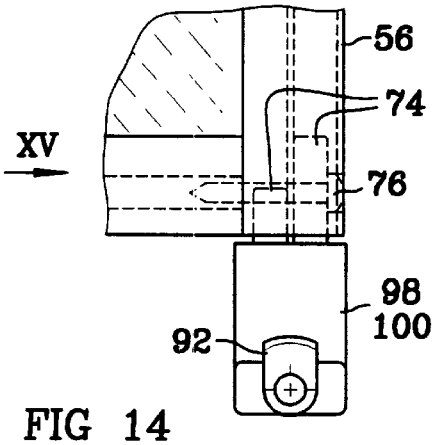
FIG. 14 is an elevation of a lower one of the fittings of the two leaves, in the direction of arrow XIV in FIG. 10.
Figure 15:
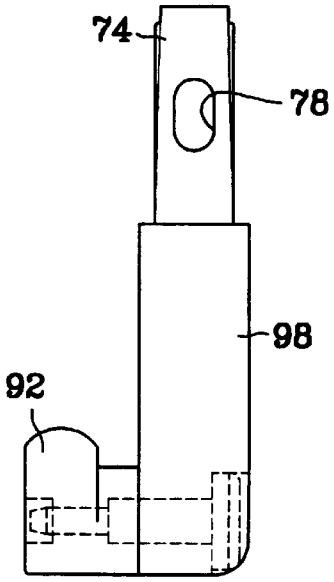
FIGS. 15 and 16 are viewed in the direction of arrow XV in FIG. 14, of the lower fittings of the two leaves respectively.
Figure 17:
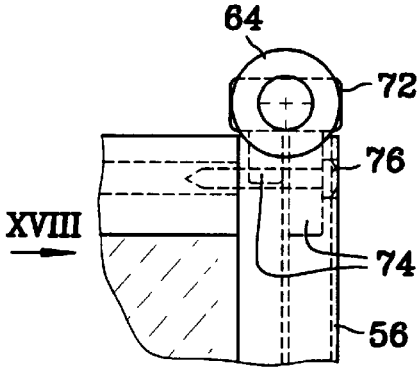
FIG. 17 is an elevation, in the direction of arrow XI in FIG. 10, of an upper fitting of the third leaf of the screen.
Figure 18:
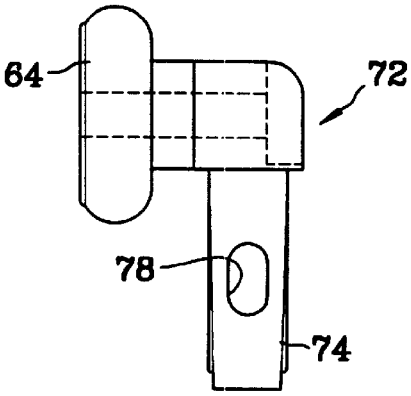
FIG. 18 is a view in the direction of XVIII in FIG. 17.
Figure 16:
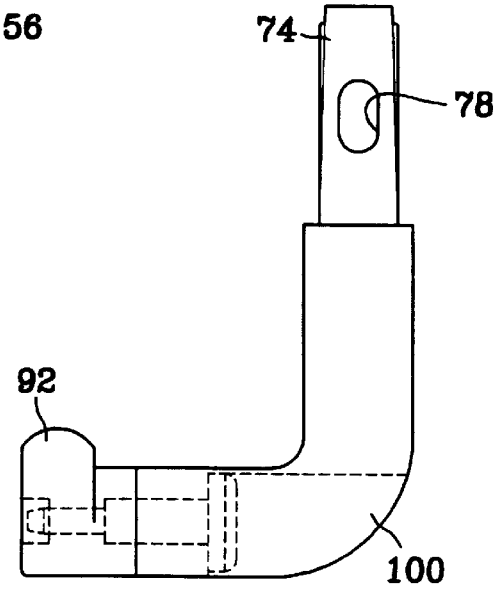

When the runner element 68 is in the position illustrated in FIGS. 10 and 20, the lobe 80 engages with the track 70, thus retaining the leaf 52.1 in position. If it is desired to remove the leaf 52.1, the spindle 82 is pivoted so as to move the lobe 80 out of engagement with the track 70. This enables the leaf 52.1 to be removed, assuming that the other two leaves 52.2 and 52.3 have already been removed.

The leaves 52.2 and 52.3 are hung and guided in a similar manner by means of runner wheels 90 at the top and sliding runner elements 92 at the bottom, the runner wheels 90 engaging with a track 94 which forms part of the upper rail 62.1, and the runner elements 92 engaging with a track 96 which forms part of the lower rail 62.2.

The runner wheels 90 and the runner elements 92 of the leaf 52.2 are mounted by means of carrier elements 98, and those of the leaf 52.3 by means of carrier elements 100. The carrier elements 100 differ from the carrier elements 98 in that their horizontal limbs or connecting portions are longer, so as to enable the two leaves to overlap one another. Their runner wheels 90 and their runner elements 92 run in the same track 94 and 96, respectively. Each of the carrier elements 98 and 100 have a pair of legs 74 similar to the carrier elements 72, one of which legs is, during installation, shortened to accommodate the corresponding glass panel 54. Otherwise, the construction is similar to that already described with respect to the leaf 52.1. In particular, the legs 74 also have slotted holes therein for purposes of height adjustment, as in the case of the carrier elements 72.

It will be seen that the space in the upper rail 62.1 above the track 94 is unobstructed, so as to enable the leaves 52.2 and 52.3 to tilt once the runner elements 92 have been displaced so as to release them from the track 96.

What is claimed is:

1. A screen which comprises two or more overlapping leaves, an upper rail on which the leaves are hung and along which they can slide, and a lower rail for guiding the lower ends of the leaves during their sliding movement, at least an outer one of the leaves having runners which engage with the upper rail, characterized in that the runners and upper rail are so constructed that the runners can tilt about a tilt axis extending along the upper rail, and that said outer leaf has a pivotally mounted element rotatable about an axis transverse to the outer leaf which is slidable alone the lower rail and pivotally displaceable between a first condition in which it engages the lower rail for guiding the outer leaf along the lower rail, and a second condition in which it is released from the lower rail, so as to enable the lower end of the outer leaf to swing transversely away from the lower rail, about the tilt axis.

2. A screen as claimed in claim 1, characterized in that the upper rail is an extrusion incorporating a track, that the runner is in the form of a runner wheel extending up from the track, that the runner wheel is connected to the respective leaf by means of a fitting which extends from one side of the runner wheel, and that the upper rail, on the other side of the runner wheel, is spaced sufficiently far from the runner wheel so as to permit said tilting movement of the runner wheel.

3. A screen as claimed in claim 1, characterized in that the upper rail comprises a portion of a bathing enclosure.

4. A screen as claimed in claim 1, characterized in that the pivotally mounted element includes an elongated connecting portion with a recessed compartment for a portion of the pivotally mounted member.

5. A screen as claimed in claim 4, characterized in that the elongated connecting portion is of one piece and has a substantially right angled configuration.

* * * * *

UNITED STATES PATENT AND TRADEMARK OFFICE

CERTIFICATE OF CORRECTION

PATENT NO. : 5,839,228

DATED : November 24, 1998

INVENTOR(S) : Philip Duffy

It is certified that error appears in the above-identified patent and that said Letters Patent is hereby corrected as shown below:

Column 4

Claim 1, line 24 - after "rail" insert --having at least two tracks--.

Claim 1, line 26 - after "movement," insert --one of said tracks guiding at least one of said leaves, and --.

Claim 1, line 33 - after "slidable" "alone" should be --along--.

Claim 1, line 33 - after "along" insert --another of said tracks of--.

Signed and Sealed this

Eighteenth Day of May, 1999

*Attest:*

Q. TODD DICKINSON

*Attesting Officer*

*Acting Commissioner of Patents and Trademarks*